US008061428B2

(12) United States Patent
Fenton et al.

(10) Patent No.: US 8,061,428 B2
(45) Date of Patent: Nov. 22, 2011

(54) NON-ORIENTATED TUBING HANGER WITH FULL BORE TREE HEAD

(75) Inventors: Stephen P. Fenton, Balmedie (GB); William D. Munro, Aberdeen (GB); Calum T. Myles, Banchory (GB)

(73) Assignee: Vetco Gray Inc., Houston, TX (US)

( * ) Notice: Subject to any disclaimer, the term of this patent is extended or adjusted under 35 U.S.C. 154(b) by 221 days.

(21) Appl. No.: 12/425,209

(22) Filed: Apr. 16, 2009

(65) Prior Publication Data

US 2009/0260832 A1 Oct. 22, 2009

Related U.S. Application Data

(60) Provisional application No. 61/045,503, filed on Apr. 16, 2008.

(51) Int. Cl.
*E21B 43/01* (2006.01)

(52) U.S. Cl. ..... 166/347; 166/339; 166/344; 166/368

(58) Field of Classification Search ..... 166/347, 166/339, 344, 368, 369, 382, 88.1, 89.1, 166/75.14

See application file for complete search history.

(56) References Cited

U.S. PATENT DOCUMENTS

| | | | | |
|---|---|---|---|---|
| 5,372,199 | A * | 12/1994 | Cegielski et al. | 166/368 |
| 5,465,794 | A * | 11/1995 | McConaughy et al. | 166/375 |
| 6,367,551 | B1 * | 4/2002 | Fenton | 166/345 |
| 6,763,891 | B2 * | 7/2004 | Humphrey et al. | 166/368 |
| 7,063,160 | B2 * | 6/2006 | Fenton et al. | 166/369 |
| 7,219,741 | B2 * | 5/2007 | Fenton et al. | 166/368 |
| 7,607,485 | B2 * | 10/2009 | Fenton et al. | 166/368 |
| 7,861,789 | B2 * | 1/2011 | Nelson | 166/348 |
| 2004/0159439 | A1 | 8/2004 | Fenton et al. | |
| 2004/0262010 | A1 * | 12/2004 | Milberger | 166/368 |
| 2005/0284640 | A1 * | 12/2005 | Borak | 166/369 |
| 2006/0191680 | A1 * | 8/2006 | Nelson | 166/208 |
| 2007/0169940 | A1 * | 7/2007 | Fenton et al. | 166/368 |
| 2011/0017467 | A1 * | 1/2011 | June | 166/368 |

FOREIGN PATENT DOCUMENTS

| | | |
|---|---|---|
| GB | 2292573 A | 2/1996 |
| GB | 2370296 B | 6/2002 |

OTHER PUBLICATIONS

Combine Search and Examination Report, Application No. GB0906546.7, dated Jul. 30, 2009.

* cited by examiner

*Primary Examiner* — Thomas Beach
*Assistant Examiner* — Matthew Buck
(74) *Attorney, Agent, or Firm* — Bracewell & Giuliani LLP

(57) ABSTRACT

A subsea wellhead assembly includes a wellhead housing, a production tree, a tubing hanger adapted to land in the wellhead assembly inside the wellhead housing without a need for angular orientation, a bridge member on the tubing hanger in the production tree, a port radially formed through the tubing hanger or the bridge member, a production port radially through the tree head housing, and an annular production flow passage that circumscribes the bridge member lower portion on one end and optionally circumscribes the tubing hanger on its other end. The annular production flow passage is in communication with both the production port and the radial port in the tubing hanger or bridge member so that fluid can be produced from the well via the annular production flow passage without necessity to orientate the tubing hanger.

20 Claims, 3 Drawing Sheets

NON-ORIENTATED TUBING HANGER WITH FULL BORE TREE HEAD

CROSS REFERENCE TO RELATED APPLICATIONS

This application claims priority to and the benefit of co-pending U.S. Provisional Application Ser. No. 61/045,503, filed Apr. 16, 2008, the full disclosure of which is hereby incorporated by reference herein.

1. Field of Invention

This invention relates in general to production of oil and gas wells, and in particular to a full bore wellhead assembly.

2. Description of Related Art

Wellheads used in the production of hydrocarbons extracted from subterranean formations typically comprise a wellhead assembly. Wellhead assemblies are attached at the upper ends of wellbores that intersect hydrocarbon producing formations. Wellhead assemblies also provide support for tubing and casing inserted into the wellbore. The casing lines the wellbore, thereby isolating the wellbore from the surrounding formation. The tubing typically lies concentric within the casing and provides a conduit for producing the hydrocarbons entrained within the formation.

Wellhead assemblies also typically include a production tree connecting to the upper end of the wellhead housing. The production tree controls and distributes the fluids produced from the wellbore. Valves assemblies are typically provided within wellhead production trees for controlling the flow of oil or gas from a wellhead and/or for controlling circulating fluid flow in and out of a wellhead. Gate valves and other sliding stem-type valves have a valve member or disc and operate by selectively moving the stem to insert/remove the valve member into/from the flow of fluid to stop/allow the flow when desired.

SUMMARY OF INVENTION

A subsea wellhead assembly includes a wellhead housing, a production tree, a tubing hanger adapted to land in the wellhead assembly inside the wellhead housing without the necessity to orientate it along the axis of the wellhead, a bridge element on the tubing hanger in the production tree, an axial passage through the tubing hanger and bridge element, a gallery passage radially formed through axial passage, a production port that radially extends through the tree head housing, and an annular production flow passage circumscribing the bridge element and the tubing hanger. The annular production flow passage is in communication with both the production port in the tree and the gallery passage, so that produced fluid in the axial passage flows to outside of the wellhead assembly.

DETAILED DESCRIPTION OF THE INVENTION

Figure 1:
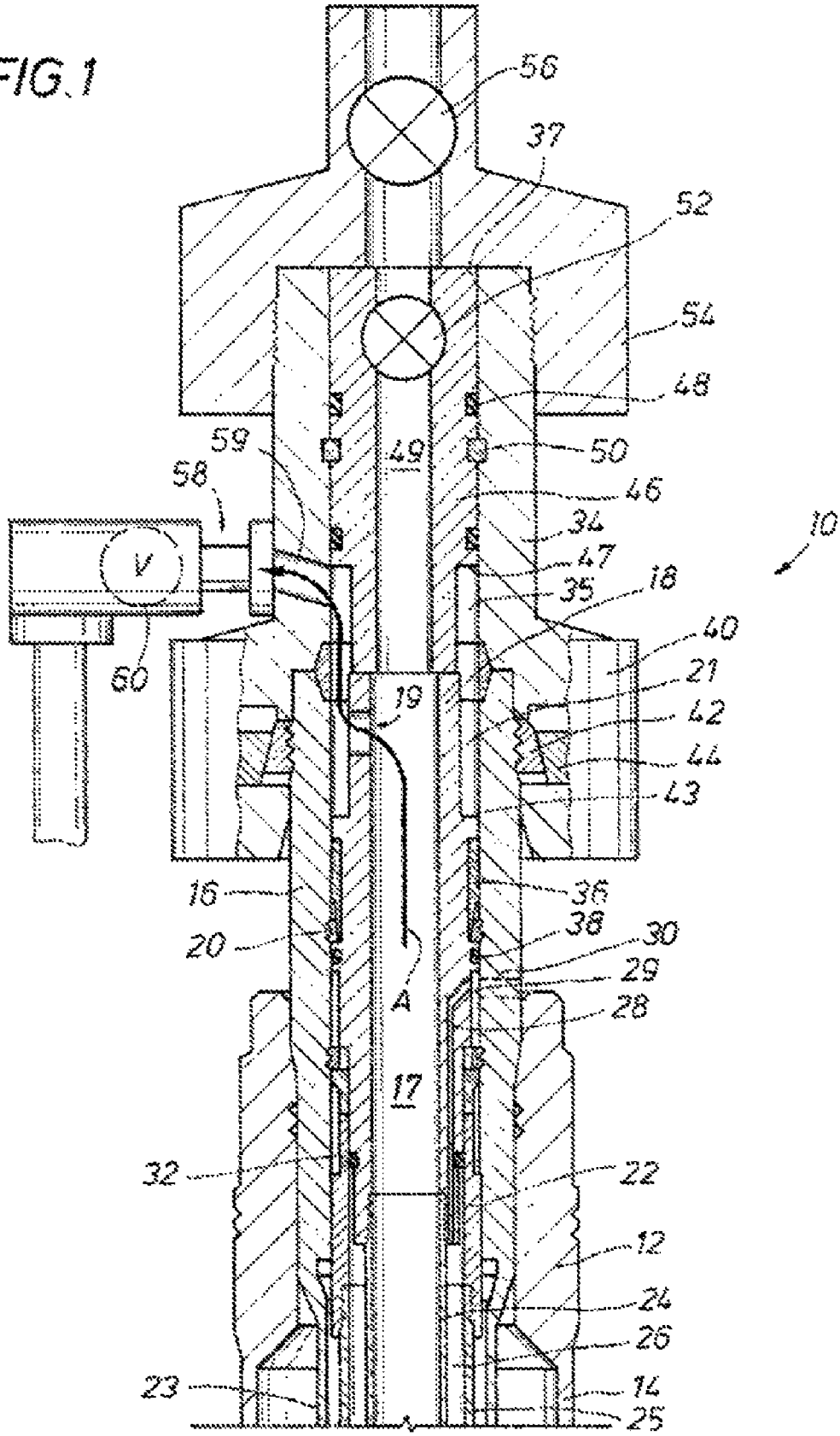
FIG. 1 is a schematic partial cross sectional view of one embodiment of a full bore wellhead assembly in accordance with the present disclosure.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides a side partial cross-sectional view of an embodiment of a wellhead assembly 10 in accordance with the present disclosure. The wellhead assembly 10 can be used with a subsea well for controlling production fluid from within a hydrocarbon producing wellbore. An outer wellhead housing 12 is at the upper end of an annular conductor pipe 14 extending into the wellbore. Coaxially disposed within the outer wellhead housing 12 is a high pressure/inner wellhead housing 16. A production tree 34 attaches to the upper end of the high pressure wellbore housing 16. A tubing hanger 18 is shown coaxially within the high pressure wellhead housing 16 and affixed to the wellhead housing 16 by a tubing hanger latch or locking member 20. An elastomeric seal 38 is shown positioned in a region between the outer circumference of the tubing hanger 18 and inner surface of the high pressure housing 16. An energizing ring 36 for engaging the locking element 20 is shown located below seal 38; the energizing ring 36 has a tapered lower end. After tubing hanger 18 is landed, locking member 20 engages the profile in wellhead housing 16 during setting of the seal 38.

The tubing hanger 18 outer diameter transitions inward above the seal 38, defining a housing annulus 21 between the tubing hanger 18 and the high pressure housing 16 inner radius. Tubing hanger 18 has an axial production flow passage 17 extending through it. A radial port 19 extends through the sidewall of tubing hanger 18 near an upper end of tubing hanger 18, communicating axial flow passage 17 with housing annulus 21. The upper end of tubing hanger 18 is flush or slightly below the upper end of high pressure wellhead housing 16.

A casing hanger 22 is shown latched to the high pressure housing 16 inner diameter; the casing hanger 22 radially circumscribes a lower portion of the tubing hanger 18. Casing hanger 22 is attached to the upper end of a string of casing 25 that is cemented in the well. Casing hanger 22 is sealed to the inner diameter of high pressure wellhead housing 16 by a seal or pack off. Production tubing 24 extends downward from tubing hanger 18 into casing 25 for conveying production fluids from the borehole into the tree 34.

A tubing annulus 26 between the production tubing 24 outer diameter and casing 25 inner circumference extends downward from tubing hanger 18. A tubing annulus passage 28 is shown axially extending within a sidewall of tubing hanger 18 offset from production passage 17. Tubing annulus passage 28 has a lower end in communication with tubing annulus 26 and an upper end that angles radially outward into communication with a tubing annulus gallery or chamber 29 that circumscribes the tubing hanger 18. Tubing hanger 18 may include more than one tubing annulus passage 28 formed therethrough. A tubing annulus port 30 is illustrated in dashed outline and formed for fluid communication with the tubing annulus gallery 29 and thus the tubing annulus passage 28. The port 30, tubing annulus gallery 29, and passage 28 provide fluid and pressure communication between the tree 34 and the tubing annulus 26. Optionally, a selectively opened and closed valve (not shown) can be in the port 30 and in communication with a control line ported to the tree 34 external to the housing 16. An example of a selectively opened and closed valve can be found in U.S. Publication No. 2007/0169940, which is incorporated by reference herein in its entirety.

The production tree 34 is attached to the wellhead at the upper end of the high pressure housing 16. A connector assembly 40 extends downward from the outer circumference of the tree 34 for attaching the production tree 34 to the wellhead. The assembly 40 includes a hydraulically actuated cam 44 and dogs 42, wherein the dogs 42 are profiled to match corresponding profiles on the outer diameter of the high pressure housing 16.

An axial bore 37 is formed through the tree 34 in which a bridge member 46 is coaxially inserted. Axial bore 37 has a diameter that is the same or larger than the inner bowl diameter of the high pressure wellhead housing 16. In one example the inner bowl diameter ranges from about 11" to about 18¾", which is commensurate with the design of the casing hanger systems of various forms. The bridge member 46 has a larger diameter upper portion and a smaller diameter lower portion, defining a shoulder or transition 47. A tree annulus 35 is formed between the bridge member 46 and the inner diameter of the tree bore 37 below the transition 47 to provide an annular production flow passage. In the embodiment shown, the bridge member 46 lower end is landed on the upper terminal end of the tubing hanger 18 and the bridge member 46 upper end terminates at about the upper terminal end of the tree 34. The engagement between bridge member 46 and tubing hanger 18 is shown schematically. A portion of bridge member 46 would stab into or over a portion of tubing hanger 18 so as to form a seal between tubing hanger production passage 17 and an axial passage 49 extending through bridge member 46. The upper end of bridge member 46 is shown flush with the upper end of tree 34. The bridge member 46 can be orientated to the top of the tubing hanger 18 via conventional mechanical means during installation. A flowline 58 connects to the tree 34 outer housing adjacent a production port 59 formed through a sidewall of tree 34 housing. The production port 59 communicates with the tree annulus 35 thus providing fluid communication from the production flowline 58 and the tree annulus 35. A wing valve 60 is shown in phantom that is inline with the flowline 58.

One or more seals 48 are provided between bridge member 46 and bore 37 inner diameter. A lock or latch mechanism 50 anchors the bridge member 46 within the body of the production tree 34. In one embodiment, the latch mechanism 50 includes a split ring compressed into a groove circumscribing the bridge member 46. The axial passage 49 in bridge member 46 and the axial passage 17 in tubing hanger 18 annulus are coaxially aligned. A tree cap 54 overlays the upper portion of the production tree 34 having a bore defining the passage 49 upper end. A master valve 52 is located within bridge member 46, and a swab valve 56 is shown in a passage in tree cap 54 line with the passage 49. Valves 52 and 56 can be gate valves, ball valves, or any valve or member able to control flow, such as a wireline installed or ROV installed plug.

Gallery passage 19 enables fluid communication between axial production passage 17 in tubing hanger 18 and housing annulus 21. The housing annulus 21 is open to the tree annulus 35, thereby providing fluid communication from within the axial production passage 17 in tubing hanger 18 to the production flowline 58. One of the advantages of the device described herein is that no orientation is required for installing the tubing hanger 18 within the wellhead assembly 10. Additionally, the assembly shown in FIG. 1 provides a full bore access through the wellhead assembly that may accommodate drilling through tree 34. Fluid flow from within the tubing hanger 18 up to the production flowline 58 is illustrated by the arrow A.

In one mode of operation, the outer wellhead housing 12 with the associated conductor pipe 14 may be installed in a well. Then, the well is drilled deeper and high pressure wellhead housing 16 and its casing 25 are installed. The operator may then install production tree 34 on the wellhead housing 16 prior to finalizing the drilling completion of the well. The operator connects a riser and blowout preventer to tree 34 and drills deeper through tree 34. When at a desired depth, the operator installs casing hanger 22 along with its casing 25 by lowering them through the riser, blowout preventer, and tree 34. If casing 25 is the last string of casing, the operator may run tubing hanger 18, which locks locking element 20 and sets seal 38. The operator then installs bridge member 46.

Figure 2:
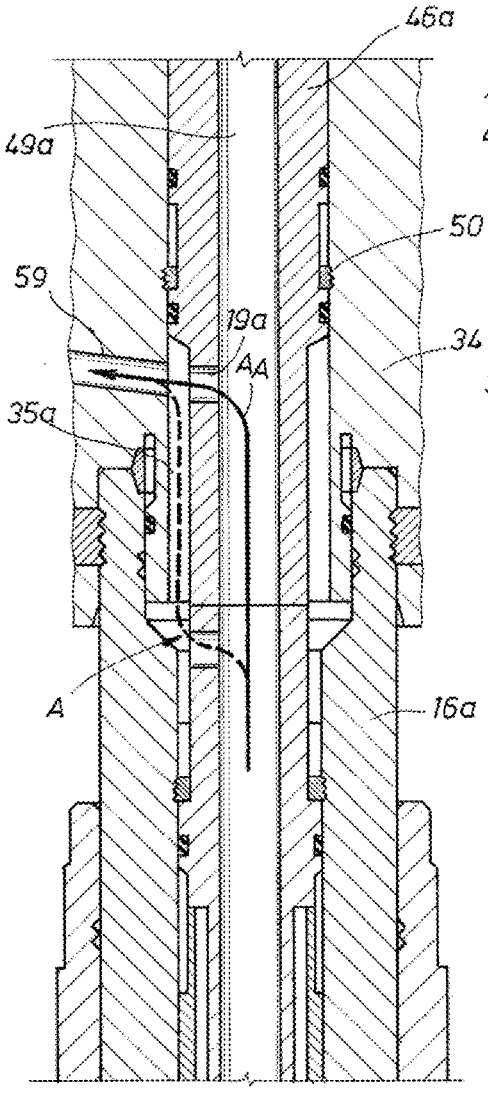
FIG. 2 depicts a full bore wellhead assembly embodiment showing an alternative tubing annulus access.
Figure 4:
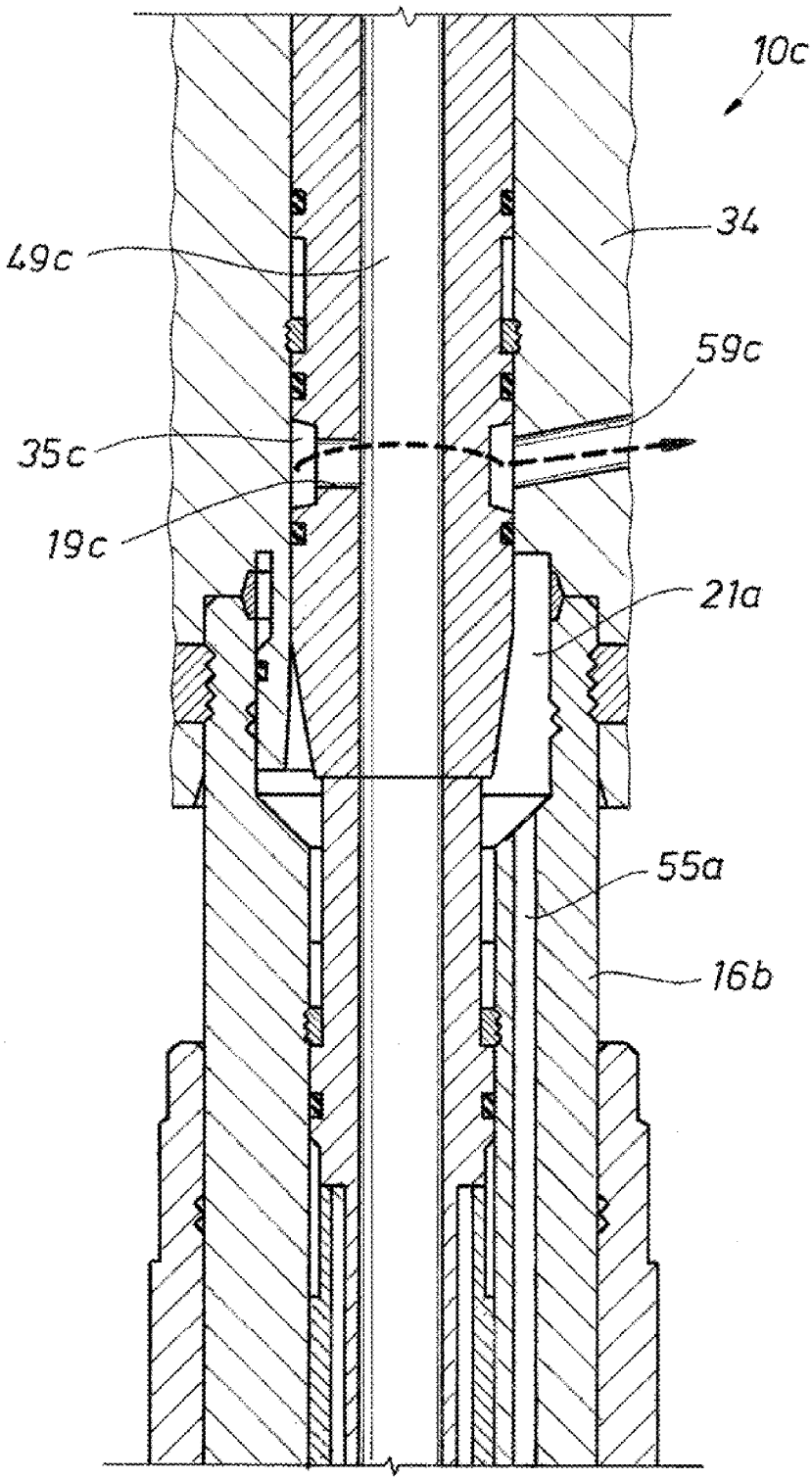

The operator may establish communication with the tubing annulus by connecting a tubing annulus line (not shown) to the tree 34, thereby communicating with the annulus via the routings indicated in FIGS. 1, 2 and 4. The operator may perforate casing 25 to complete the well by lowering a perforating gun through the passage 49, and tubing hanger 18 into tubing 24. After completion, the operator disconnects the riser and installs tree cap 54. During production, master valve 52 and swab valve 56 are closed. Alternative operational sequences may be performed, including drilling the well to total depth and installing tubing hanger 18 before installing tree 34. If so, a temporary abandonment cap (not shown) could be placed on the upper end of wellhead housing 16 until tree 34 is installed.

An alternative wellhead assembly 10 embodiment is illustrated in FIG. 2 depicting the radial port 19*a* in the bridge member 46 and proximate to the production port 59. Providing the radial port 19*a* in the bridge member 46 rather than the tubing hanger 18 may depend on where the tubing hanger 18 upper end terminates. In this embodiment, production flow of fluid follows arrow $A_A$ into the bridge member 46*a* to port 19*a* instead of arrow A through port 19.

Figure 3:
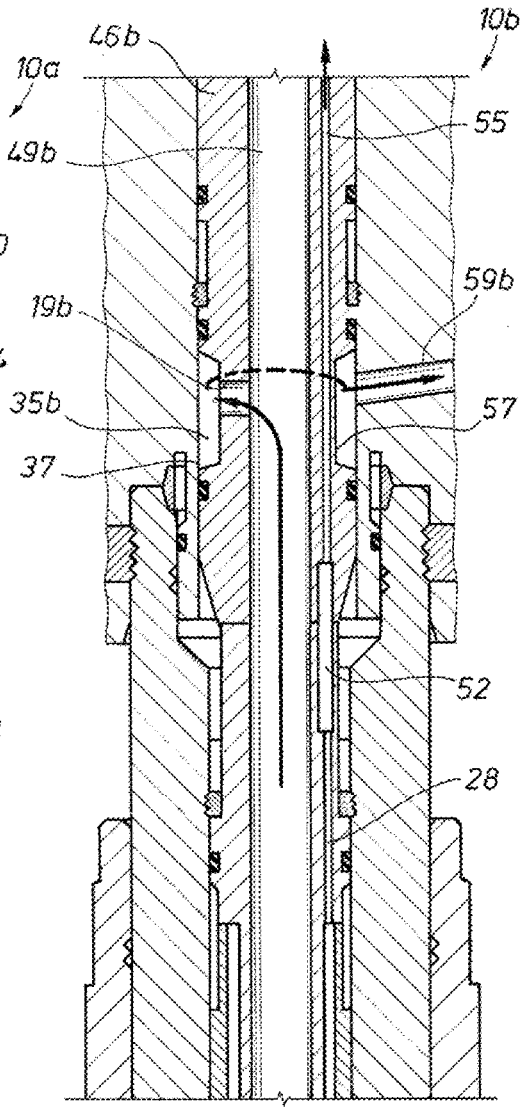
FIGS. 3 and 4 depict alternative embodiments of a wellhead assembly.

Alternative wellhead housing assemblies 10*b*, 10*c* are illustrated in side sectional views in FIGS. 3 and 4. Referring now to FIG. 3, an alternative bridge member 46*b* is depicted having a circumferential channel 57 provided on its outer radial surface. The bridge member 46*b* outer surface is shown in sealing contact with the tree bore 37 above and below the channel 57 thereby defining the tree annulus 35*b* therein. The tree annulus 35*b* communicates directly with the production port 59 and with the axial passage 49*b* through a gallery passage 19*b* laterally formed through the bridge member 46*b*. The bridge member 46*b* of FIG. 3 further depicts an upper passage 55 with its lower end registering with the tubing annulus passage 28 and receiving therein an isolation valve 52. An example of an isolation valve suitable for use herein is found in U.S. Pat. No. 7,219,741, which is incorporated by reference herein in its entirety.

FIG. 4 presents a wellhead housing assembly 10*c* embodiment with an upper bypass passage 55*a* routed axially through the wellhead housing 16*b* and housing annulus 21*a* and then laterally outside of the wellhead assembly 10*c* through the production tree. In both the configurations provided in FIGS. 3 and 4, the path of produced fluid, as represented by the arrows, moves axially upward within the passage 49*b*, 49*c*, flows into the tree annulus 35*b*, 35*c* through the gallery passage 19*b*, 19*c*, and then through the production port 59*b*, 59*c*. The bypass passages 28, 55 can be employed for creating a return flow path when injecting something into the wellbore, such as cement, downhole fluids, and the like. Moreover, the bypass configurations are not limited to the particular embodiment illustrated herein, but can be included with each of the embodiments of the present disclosure. Similarly, the various production flow paths presented can be adapted or used in wellhead assemblies other than the configuration provided.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A subsea wellhead assembly comprising:

a wellhead housing having an axial bore;

a production tree secured to the wellhead housing upper end;

a tree bore axially formed in the production tree and coaxially aligned with the housing axial bore;

a tubing hanger landed in the wellhead housing;

a bridge member atop the tubing hanger and coaxially disposed in the tree bore;

an axial passage extending coaxially within the tubing hanger and bridge member;

a production port extending laterally through a sidewall of the production tree above an uppermost end of the tubing hanger;

an annular production flow passage within the tree bore and circumscribing the bridge member and tubing hanger; and a production flow passage laterally extending from the axial passage into communication with the annular production flow passage, so that landing the tubing hanger in any azimuthal orientation in the wellhead housing creates communication between the axial passage to the lateral production port in the tree via the production flow passage and annular production flow passage.

2. The subsea wellhead assembly of claim 1, further comprising casing depending downward into a wellbore, tubing within the casing, and a tubing annulus between the tubing and the casing.

3. The subsea wellhead assembly of claim 2, further comprising:

a bypass annulus between the tubing hanger and the wellhead housing that is sealed from the annular production flow passage; and a tubing annulus passage extending through the high pressure wellhead housing and routed to the tree.

4. The subsea wellhead assembly of claim 1, wherein the production flow passage is in selected from the list consisting of the bridge member and the tubing hanger.

5. The subsea wellhead assembly of claim 1, wherein the production flow passage in the bridge member.

6. The subsea wellhead assembly of claim 1, wherein the production flow passage is formed at a single azimuthal location.

7. The subsea wellhead assembly of claim 1, further comprising a tree cap selectively attachable in the production tree upper section.

8. The subsea wellhead assembly of claim 1, further comprising:

a tubing hanger locking member on an exterior portion of the tubing hanger;

a tubing hanger seal on the tubing hanger that sealingly engages the wellhead bore; and a downward-facing shoulder on the tubing hanger below the tubing hanger seal and the locking member that locates the tubing hanger on a casing hanger in the wellhead.

9. The subsea wellhead assembly of claim 1, further comprising:

a tubing hanger locking member on an exterior portion of the tubing hanger;

a mating profile in the axial bore of the wellhead housing that is engaged by the locking member;

an energizing ring above the locking member and having a tapered portion that engages the locking member to force engagement with the mating profile in the wellhead housing.

10. The subsea wellhead assembly of claim 1, wherein the bore of the tree has a minimum inner diameter that is at least equal to a minimum inner diameter of the bore of the wellhead housing.

11. A subsea wellhead assembly comprising:

a wellhead housing;

a production tree secured to the wellhead housing upper end;

a bore extending axially through the production tree and the wellhead housing;

a tubing hanger landed in the wellhead housing and having a string of tubing depending downward therefrom;

a tubular bridge member atop the tubing hanger and coaxially disposed in the bore and having at least a portion within the tree;

a passage projecting axially through the tubing hanger and the bridge member;

a production port laterally projecting through the production tree above an uppermost end of the tubing hanger;

an annular production flow passage coaxially provided within the bore, circumscribing a portion of the bridge member and tubular hanger, and in communication with the production port;

a lateral port radially projecting outward from the axial passage in communication with the annular production flow passage; and a flow path defined through the tubing, into the tubing hanger, through the lateral port to the annular production flow passage, and out through the production port.

12. The subsea wellhead assembly of claim 11, wherein the lateral port is formed through a tubular selected from the list consisting of the bridge member and the tubing hanger.

13. The subsea wellhead assembly of claim 11, further comprising:

an annulus between the tubing hanger and the wellhead housing that is sealed from the annular production flow passage; and a tubing annulus passage extending through the high pressure wellhead housing and routed to the tree.

14. The subsea wellhead assembly of claim 11, further comprising a seal circumscribing the tubing hanger at a location below the annular production flow passage and above a tubing annulus gallery, thereby blocking communication between the annular production flow passage and the tubing annulus gallery.

15. The subsea wellhead assembly of claim 11, further comprising:

a tubing hanger locking member on an exterior portion of the tubing hanger;

a mating profile in the wellhead housing that is engaged by the locking member;

an energizing ring above the locking member and having a tapered portion that engages the locking member to force the locking member into engagement in the mating profile.

16. A method of assembling a subsea wellhead assembly comprising:

securing an annular wellhead housing on the seafloor;

deploying a production tree having an axial bore on the wellhead housing thereby defining a main bore that extends through the wellhead housing and the production tree, the production tree further including a production port extending laterally through a sidewall of the production tree, an annular production flow passage coaxially provided within the bore that is in communication with the production port;

landing a tubing hanger with attached tubing in the wellhead housing with an uppermost end of the tubing hanger below the production port;

disposing a lowermost end of an annular bridge element on top of the uppermost end of the tubing hanger and within the production tree so that a portion of the tubing hanger and bridge element is circumscribed by the annular flow passage;

coaxially aligning the lowermost end of the bridge element with the uppermost end of the tubing hanger so that respective inner surfaces of the bridge element and tubing hanger define an axial passage formed coaxially within both the tubing hanger and bridge element; and forming a lateral port between the axial passage and the annular production flow passage, so that the axial passage is in communication with the production port.

17. The method of claim 16, further comprising setting a locking member on the tubing hanger and a seal on the tubing hanger.

18. The method of claim 16, wherein landing the tubing hanger comprises lowering the tubing hanger through the production tree bore.

19. The method of claim 16, wherein landing the tubing hanger is performed without orienting the tubing hanger.

20. The method of claim 16, further comprising:

providing a tubing annulus between the tubing hanger and the wellhead housing that is sealed from the annular production flow passage; and providing a tubing annulus passage extending through the high pressure wellhead housing, and communicating the tubing annulus passage with the tree.

* * * * *